United States Patent [19]

Folsbeg

[11] Patent Number: 4,636,302

[45] Date of Patent: Jan. 13, 1987

[54] SEPARATOR

[75] Inventor: Jan Folsbeg, Copenhagen, Denmark

[73] Assignee: F. L. Smidth & Co. A/S, Denmark

[21] Appl. No.: 734,451

[22] Filed: May 15, 1985

[30] Foreign Application Priority Data

Jun. 14, 1984 [GB] United Kingdom ..... 8415190

[51] Int. Cl.[4] ..... B07B 7/083

[52] U.S. Cl. ..... 209/144; 209/139 A; 209/148

[58] Field of Search ..... 209/144, 133, 148, 142, 209/139.1, 139.2, 138, 145; 241/79.1, 119

[56] References Cited

U.S. PATENT DOCUMENTS

| | | | |
|---|---|---|---|
| 2,753,996 | 7/1956 | Kaiser | 209/139.1 |
| 2,939,579 | 6/1960 | Hardinge | 209/144 |
| 3,670,886 | 6/1972 | Hosokawa et al. | 209/144 |
| 4,236,997 | 12/1980 | Wessel et al. | 209/144 |
| 4,260,478 | 4/1981 | Hosokawa et al. | 209/139.2 |

FOREIGN PATENT DOCUMENTS

| | | | |
|---|---|---|---|
| 894803 | 9/1953 | Fed. Rep. of Germany | 209/148 |
| 940447 | 2/1956 | Fed. Rep. of Germany | 209/139.2 |
| 301765 | of 1928 | United Kingdom | 209/133 |
| 644484 | 10/1950 | United Kingdom | 209/145 |
| 694219 | 7/1953 | United Kingdom | 209/144 |
| 2110962 | 6/1983 | United Kingdom | 209/142 |
| 563197 | 6/1977 | U.S.S.R. | 209/144 |
| 940878 | 7/1982 | U.S.S.R. | 209/133 |

*Primary Examiner*—S. Leon Bashore
*Assistant Examiner*—Thomas M. Lithgow
*Attorney, Agent, or Firm*—Brumbaugh, Graves, Donohue & Raymond

[57] ABSTRACT

A separator has a rotor (1) with radial vanes (12) between plates (8,11). Material to be sorted is supplied, entrained in a conveying gas, through an inlet duct (6) to some rotor vane interspaces through inlet openings (13). The flow is then radially outwards, around the vane ends, radially into the other vane interspaces and into an outlet duct (9) through outlet openings (14), carrying the fine fraction. The coarse fraction is flung outwards by the vanes and collected in a hopper (4).

5 Claims, 4 Drawing Figures

SEPARATOR

The invention relates to a separator for sorting granular material suspended in a conveying gas into a fine fraction and a coarse fraction, the separator comprising a rotor with substantially radial vanes and a cylindrical housing encasing the rotor, the housing having an axial inlet duct leading to one end of the rotor for supply of unsorted material and an axial outlet duct leading from the other end of the rotor for discharging the separated fine fraction. Such a separator is hereinafter referred to as of the kind described.

A separator of this kind with a vertical rotor axis is known from DE No.-A-2036891 the rotor having two groups of radial vanes, the two groups being axially separated by a partition wall. In this separator the material to be sorted, suspended in a conveying gas, flows into the rotor through an inlet opening in the separator bottom to the lower group of vanes and from there radially out between these vanes, further up around the rotor and in between its upper group of vanes and further out through a central opening in the top of the rotor. On its way through the rotor the suspended material is sorted into a coarse fraction, which is caught by the vanes and thrown out towards the inside of the rotor housing down which it falls into an outlet hopper in the separator bottom, and a fine fraction, which, entrained in the conveying gas, leaves the separator at its top and is carried away to be separated from the gas in a precipitator.

In this known separator there is, at the bottom of the separator housing below the rotor, an additional supply of conveying gas which assists in conveying the material suspension flowing radially out from the lower vane group of the rotor further up to the upper vane group, and also in blowing through the unsorted coarse fraction for further separation of the fine fraction from the coarse fraction.

The present invention relates to a separator of the kind described, and is characterized in that the inlet end of the rotor has inlet openings interconnecting the inlet duct with only some of the rotor vane interspaces, and that the outlet end of the rotor has outlet openings interconnecting the remainder of the rotor vane interspaces with the outlet duct.

The gas flow entraining the material thus passes from the inlet duct into some of the rotor vane interspaces, radially outwards, around the ends of at least the trailing vanes, radially into the other rotor vane interspaces, and out through the outlet duct, while the coarse fraction is subjected to centrifugal separation from the fine fraction.

Compared to the separator described in DE No.-A-2036891, the separator according to the invention is distinguished by a significantly simpler rotor construction as the latter needs only one group of vanes. In addition, it is unnecessary to provide conveyance of the material suspension in the axial direction from one part of the rotor to the next as the radial outflow and inflow between the rotor vanes take place at the same axial level.

The rotor may advantageously be constructed in such a way that half of the rotor vane interspaces communicate with the inlet duct and half with the outlet duct e.g. so that every second vane interspace communicates with the inlet duct.

To supply additional gas to further improve the separation, the rotor housing, abreast of the rotor, may have a tangential gas inlet oriented in the direction of rotation of the rotor.

The invention will now be explained further by means of examples illustrated in the accompanying drawings, in which.

Figure 1:
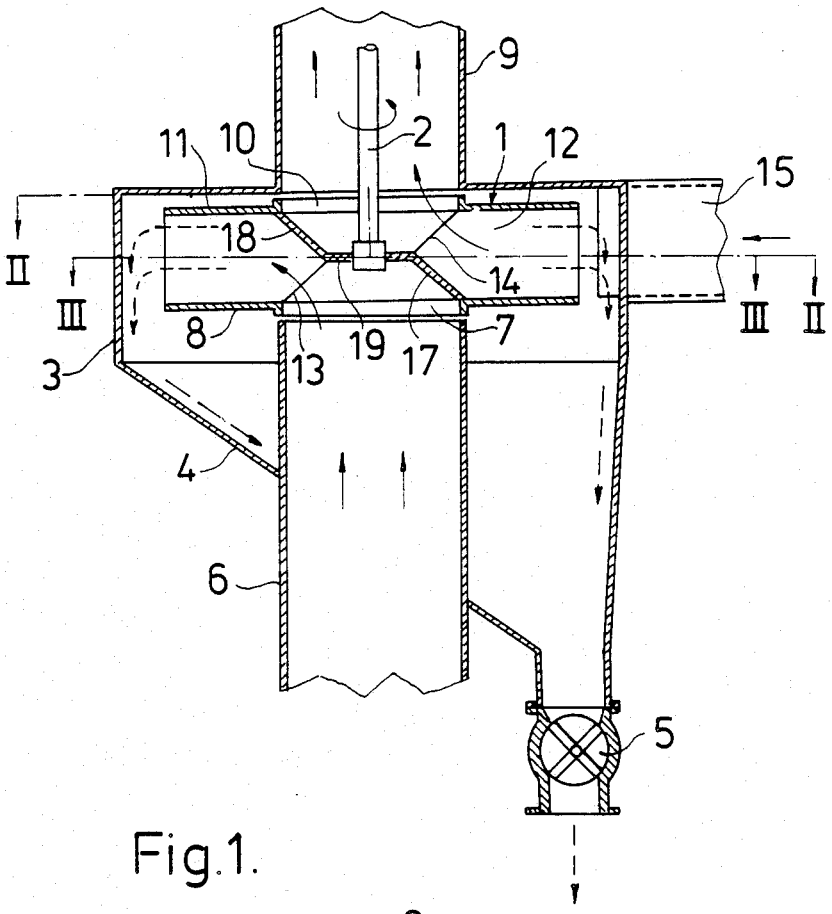
FIG. 1 is an axial sectional through one separator.
Figure 2:
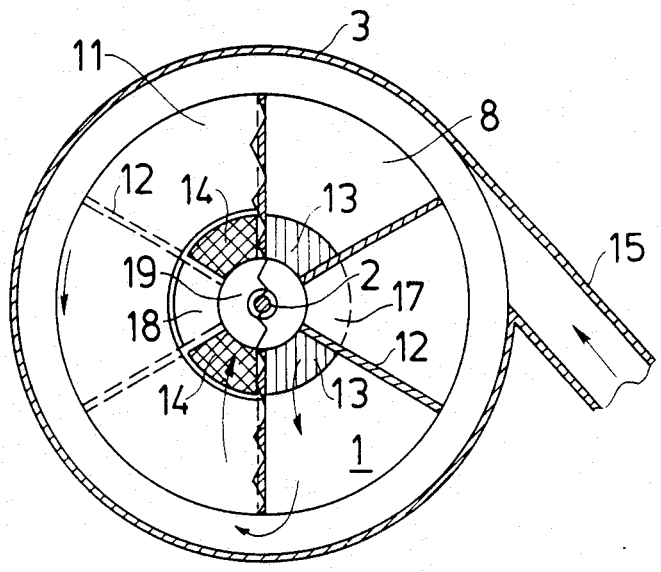
FIG. 2 is a section taken on the line II—II in FIG. 1.
Figure 3:
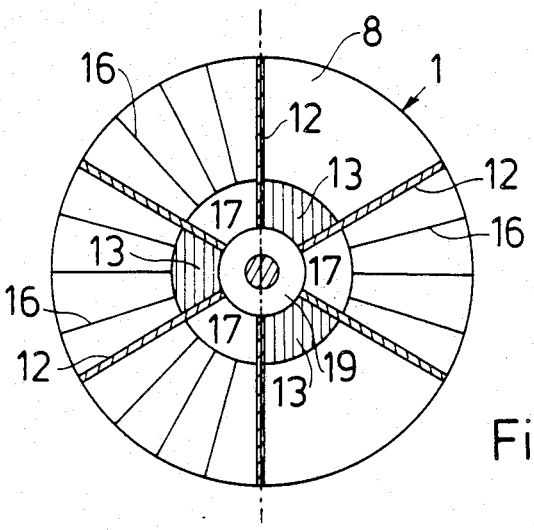
FIG. 3 is a section taken on the line III—III in FIG. 1, but showing two examples of a separator rotor; and, FIG. 4 is a diagrammatical axial sectional view through a separator with a horizontal axis.

The separator of FIGS. 1 to 3 has a rotor 1 which is rotatable about a vertical axis and driven by a motor not shown, via a shaft 2. The rotor 1 is encased by a cylindrical housing 3, the bottom of which is shaped like a hopper 4 leading e.g. to an outlet sluice 5.

A pipe 6 for supplying unsorted material suspended in a carrier gas to the separator leads to a central opening 7 in a bottom plate 8 of the rotor, whereas at the top of the housing 3 there is a second pipe 9 for carrying away a fine fraction of the material separated in the rotor. This pipe 9 leads from a central outlet opening 10 in a top plate 11 of the rotor.

Between its bottom and top plates 8 and 11 the rotor has substantially radial vanes 12. As appears from FIGS. 1 and 2 only every second vane interspace has an inlet opening 13 communicating with the supply pipe 6, whereas the remaining vane interspaces have outlet openings 14 communicating with the outlet pipe 9. The openings 13 and 14 are formed in frustoconical hubs projecting from the plates 8 and 11 and integral with one another. The hubs may be formed by cutting a substantially circular plate to form flaps 17 and 18, which are alternately bent upwards and downwards between respective pairs of adjacent vanes out of the plane of a common hub disc 19, and the edges of which are welded to the vanes 12 and plates 8 or 11. The hub disc 19 provides the connection of the rotor to the shaft 2. The frustoconical hubs provide a smooth flow path for the suspension into and out of the rotor.

In FIG. 2, the left side of the Figure shows the rotor seen from the top towards the plate 11 with the outlet openings 14, which for the sake of clarity are double-hatched and which open from the interior of the rotor up towards the reader, while the right side of the figure shows the rotor without the top plate 11 so that the bottom plate 8 can be seen with its inlet openings 13, which for the sake of clarity are hatched and which open from the interior of the rotor away from the reader.

The separator shown operates in the following way. The material to be sorted is supplied, suspended in carrier gas, through the pipe 6 from where the suspension flows into the rotor via the opening 7 and further out into every second vane interspace through the openings 13 as indicated by solid arrows in FIG. 1. A first separation of the material takes place by the radial outflow through every second vane interspace, by which the heavy grains in known manner by a combined action from the gas flow and from the centrifugal force provided by the rotor are flung towards the encasing housing 3, down the inner wall of which the coarser grains fall towards the outlet sluice 5 as indicated by dotted arrows in FIG. 1.

As indicated by solid arrows in FIG. 2 the conveying gas having left one of the vane interspaces moves, seen in the direction of rotation, around the rearmost vane of a vane interspace and flows into the rotor proper again through the following vane interspace(s) having an outlet opening 14. Further separation also takes place in the vane interspace(s) with outlet openings 14 due to the gas flow combined with the centrifugal action of the rotor whereafter the separated fine fraction of the material leaves the rotor with the conveying gas through the central opening 10 and the outlet pipe 9.

In addition to the double separation of the suspension by the radial outflow away from and the radial inflow back into the rotor the latter also ensures extra separation of the material by an excellent blowing-through of the material.

If additional gas supply is desired to provide further blow-through of the material, and consequently further improve the separation, the separator may have a tangentially oriented gas supply pipe 15 as shown in FIGS. 1 and 2.

In FIG. 3 is indicated how additional, possibly shorter, vanes 16 may be mounted in the interspaces between the vanes 12. These additional vanes 16 may, as shown to the left in FIG. 3, be mounted in each vane interspace 12-12 to increase the efficiency of the rotor or, as shown to the right in FIG. 3, only in some of the vane interspaces 12-12, by which it is possible further to influence the known and unavoidable distribution of a separator feed into a fine fraction and a coarse fraction.

Figure 4:
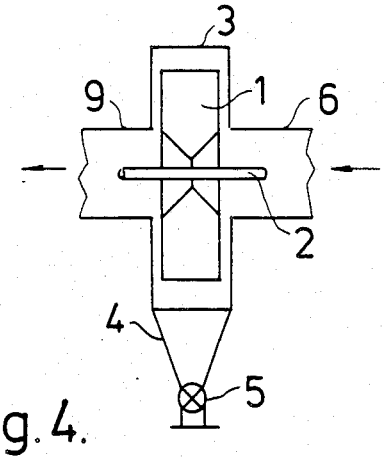

In FIG. 4 is shown a separator according to the invention, but with a horizontal axis. The references in this Figure correspond to the ones used in FIGS. 1 and 2.

I claim:

1. In a separator for sorting granular material suspended in a conveying gas into a fine fraction and a coarse fraction, said separator comprising a rotor with substantially radial vanes defining interspaces therebetween, connection means for connecting said vanes to a shaft support means, upper and lower annular plates mounted to the top and bottom, respectively, of said vanes and further defining a top and bottom of each interspace, and a cylindrical housing encasing said rotor and defining a gap between said housing and said rotor, said separator further comprising an axial inlet duct leading to an inlet end of said rotor for the supply of unsorted material and an axial outlet duct leading from an opposite outlet end of said rotor for discharging said separated fine fraction, said connection means and one of said plates defining inlet openings and flap means for permitting the supply of unsorted material and conveying gas to pass from said inlet duct into some of said interspaces while preventing the unsorted material and said conveying gas from passing to the rest of the interspaces, said connection means and the other of said plates defining outlet openings and flap means for permitted the fine fraction and conveying gas to pass from said rest of said interspaces to the outlet duct while preventing said fine fraction and conveying gas from passing into said some of said interspaces, said connection means being connected to said upper and lower plates such that the only axial conveying of said conveying gas and granular material from the inlet duct to the outlet duct is via a plurality of flow paths.

2. A separator according to claim 1, wherein half of said rotor vane interspaces are interconnected with said inlet duct through said inlet openings and the other half of said rotor vane interspaces are interconnected with said outlet duct through said outlet openings.

3. A separator according to claim 2, characterized in that every second one of said vane interspaces is interconnected with said inlet duct.

4. A separator according to claim 1, wherein said housing has, abreast of said rotor, a tangential gas inlet oriented in the direction of rotation of said rotor.

5. A separator according to claim 1, wherein said plates each have both a central opening facing an end of a respective one of said ducts and wherein said connection means include an annular hub within said central openings and wherein said flap means comprise radially extending flaps alternately bent upwardly and downwardly, each of said upwardly bent flaps being attached to two of said vanes and said upper plate, and each of said downwardly bent flaps being attached to two of said vanes and said lower plate.

* * * * *

UNITED STATES PATENT AND TRADEMARK OFFICE

CERTIFICATE OF CORRECTION

PATENT NO. : 4,636,302

DATED : January 13, 1987

INVENTOR(S) : Jan Folsberg

It is certified that error appears in the above-indentified patent and that said Letters Patent is hereby corrected as shown below:

Column 4, line 20, change the period to a comma and insert --each of said paths running from said inlet duct through one of said openings, radially outwardly through one of said some of said interspaces, around the radially outer end of at least one of the vanes defining said interspace and through the gap, and thence radially inwardly through one of said rest of said interspaces, and through one of said outlet openings to said outlet duct.--

Signed and Sealed this

Twenty-third Day of November, 1993

*Attest:*

Bruce Lehman

BRUCE LEHMAN

*Attesting Officer*

*Commissioner of Patents and Trademarks*